US005983971A

United States Patent [19]

Miller et al.

[11] Patent Number: 5,983,971

[45] Date of Patent: Nov. 16, 1999

[54] REINFORCED BURGLAR- AND STORM-RESISTANT COVER FOR WINDOWS AND DOORS

[75] Inventors: James V. Miller, Glen Ellyn, Ill.; Ira J. Alligood, 1160 Hillsboro Mile P.H., Hillsboro Beach, Fla. 33062

[73] Assignee: Ira J. Alligood, Hillsboro Beach, Fla.

[21] Appl. No.: 08/997,023

[22] Filed: Dec. 23, 1997

[51] Int. Cl.[6] ..... E06B 9/30

[52] U.S. Cl. ..... 160/172 R; 160/7; 160/168.1 R; 160/170 R; 49/90.1

[58] Field of Search ..... 160/2, 7, 33, 34, 160/131, 132, 168.1 R, 170 R, 172 R, 167 R, 174 R, 177 R; 49/90.1

[56] References Cited

U.S. PATENT DOCUMENTS

| | | | |
|---|---|---|---|
| 2,328,305 | 8/1943 | De Stefano | 160/170 R |
| 2,337,230 | 12/1943 | Christianson | 49/90.1 X |
| 3,051,231 | 8/1962 | Alvarez | 160/172 R X |
| 3,578,060 | 5/1971 | Spencer | 160/172 R |
| 3,857,433 | 12/1974 | Gatzi | 160/172 R |
| 3,872,911 | 3/1975 | Janes | 49/90.1 X |
| 4,173,721 | 11/1979 | Louis | 160/2 X |
| 4,236,566 | 12/1980 | Hensel | 160/130 |
| 4,424,850 | 1/1984 | Klein | 160/133 |
| 4,493,356 | 1/1985 | Hermann et al. | 160/133 |
| 4,747,441 | 5/1988 | Apolzer et al. | 160/84.1 |
| 5,282,514 | 2/1994 | Felcetto | 160/172 R X |
| 5,316,065 | 5/1994 | Alligood | 160/170 |
| 5,413,161 | 5/1995 | Corazzini | 160/7 |
| 5,501,261 | 3/1996 | Peale | 160/172 X |
| 5,576,581 | 11/1996 | Iannuzzi et al. | 160/7 X |
| 5,584,331 | 12/1996 | Lin | 160/172 R |
| 5,675,487 | 10/1997 | Patterson et al. | 160/7 X |

FOREIGN PATENT DOCUMENTS 27 05 119 8/1978 Germany .

*Primary Examiner*—Daniel P. Stodola
*Assistant Examiner*—Bruce A. Lev
*Attorney, Agent, or Firm*—Marshall, O'Toole, Gerstein, Murray & Borun

[57] ABSTRACT

A burglar- and weather-resistant cover for an opening such as a door or window. The cover includes a pair of opposed and generally parallel tracks with an upper housing extending therebetween. A plurality of louvers are generally parallel and connected to the upper housing by a first cable in a manner that allows the first cable to be coiled, and to a pair of second cables which engage the louvers in a manner that spaces the louvers at regular intervals. The cover further includes a pair of locking members, with each locking member coupled to one of the tracks an movable between a first position and a second position. The locking members are adapted to automatically move from the first to the second position when the louvers are deployed from a retracted position to a deployed position. The cover further includes a plurality of spacing members positioned at regular intervals along the second cables and engage the horizontal flanges of the louvers such that the vertical flange of one louver overlaps the next lower louver. The spacing members prevent movement of the engaged louvers in either direction along the second cables, thereby preventing the separation of adjacent louvers.

21 Claims, 6 Drawing Sheets

REINFORCED BURGLAR- AND STORM-RESISTANT COVER FOR WINDOWS AND DOORS

BACKGROUND OF THE INVENTION

1. Field of the Invention

The present invention relates to protective window coverings and, more particularly, to a reinforced burglar- and storm-resistant cover for windows and doors.

2. Description of Related Art

It is often desirable to protect the windows, doors, and other openings of homes and business establishments from intrusion by unwelcome elements. Protective covers are used to secure an area from burglary and vandalism, and also to provide protection from weather-related effects such as violent storms or hurricanes. Conventional covers used for this purpose include rolling protective shutters which are constructed of a plurality of interconnected elongate slats or louvers.

In one form, a protective cover includes a frame which houses a plurality of L-shaped louvers which are deployable to form a curtain which covers the opening. One such protective cover is disclosed in U.S. Pat. No. 5,316,065 to Alligood. The louvers disclosed in the Alligood patent have a horizontal flange through which support and deployment cables pass, and a vertical flange extending downwardly from the horizontal flange proximate the front of the cover. The louvers are retained within a pair of tracks and an upper housing in a retracted position when the window, door, or other opening is exposed. In this position, the louvers are stacked one on top of another, with the stack having a combined thickness equal to the width of a horizontal flange plus the thicknesses of each of the vertical flanges. Accordingly, channels in the tracks dimensioned to accommodate the combined thickness of the stacked shutter.

To provide protection for the door or window, the louvers are lowered to a deployed position, thus forming a curtain which covers the opening. In the deployed position, the louvers are spaced such that the vertical flange of one of the louvers overlaps the louver immediately below. In this way, the curtain formed by the louvers completely covers the opening.

Positive pressure is caused by high speed winds blowing against the outside of the building and the shutter curtain. The Alligood shutters can withstand wind loads up to at least about 250 mph.

As positive pressure is created on one side of the building, negative pressure is created on the opposite side of the building as the high speed winds pass over and around the building. The negative pressure on the opposite side of the building is significantly less than the pressure inside the building and may pull out the walls, windows and roof if the pressure in the house is not equalized to match the negative pressure. To equalize the pressure, the vertical flanges of the Alligood shutters instantly deflect outwardly slightly from the overlapped horizontal flanges to place the interior of the building in fluid communication with the exterior. In this way, the pressure differential decreases as the internal pressure equalizes with the negative pressure, thereby preventing the walls, windows and roof from being pulled away from the interior.

In the deployed position, the louvers are no longer stacked and, consequently, a narrower channel can accommodate the louvers. The maximum thickness of the curtain in the deployed position is equal to the width of one horizontal flange plus the thickness of one vertical flange. Because the channels of the tracks are wide enough to accommodate the stacked louvers, the deployed curtain has room to move laterally within the channels and to allow a person to lift the curtain and gain access to the covered opening. To address this problem, Alligood provides two manual mechanisms which essentially narrow the channel when the curtain is deployed to prevent substantial lateral movement of the louvers within the channel.

In a first embodiment, a pair of hinged plates are provided, with each plate running parallel and connected by hinges to one of the tracks. The plates are provided with notches corresponding to horizontal flanges of the louvers extending rearwardly in the channels. After the louvers are deployed, the hinged plates are manually positioned in the channels by rotation about the hinges. In this position, the notches in the plates engage the corresponding horizontal flanges to prevent substantial lateral or horizontal movement of the louvers.

The Alligood patent discloses an alternative mechanism in the form of elongated locking angle members. Each of the angle members is located within one of the channels with a lower end pivotally connected to the track proximate the bottom of the channel. The point of connection is located at a distance from the front wall of the track slightly greater than the width of the deployed curtain. In the retracted position, an upper end of the angle member is placed against the back wall of the track to accommodate the stacked louvers. In the deployed position, the upper end of the angle member is manually rotated into position against the louvers and is locked in place by securing the upper end to the side wall of the track.

While these mechanisms effectively provides bracing for the louvers, the manual nature of these mechanisms presents challenges in operation. For example, the hinged plate mechanism requires access from the inside of the cover to rotate the plate into position and, therefore, cannot be used with windows that cannot open, such as plate glass windows on store fronts. Additionally, covers using the angle member mechanism wherein the locking pin or bolt is inserted from the outside of the cover will be difficult to lock when mounted on windows on the second floor or higher. Therefore, a need exists for a mechanism for bracing the curtain which is automatically engaged when the louvers are deployed to cover an opening.

The Alligood patent also discloses that the louvers are suspended in a desired spaced relationship by crimping stop-like members, for example mechanical pop-rivets, to support cables which extend through aligned holes in the louvers. The stop-like members prevent the louvers from moving in the downward direction along the cables, but do not prevent a louver from being lifted upwardly away from the next lower louver, thereby exposing the opening.

To prevent separation of the louvers and to strengthen the curtain, vertically disposed reinforcing members, or unitizing bars, are positioned periodically in engagement with the louvers. These unitizing bars are manually placed in contact with the louvers to prevent relative vertical movement of the deployed louvers. However, as with the locking mechanisms, the unitizing bar presents a difficulty in application for windows that do not open and some windows located above the first floor. Therefore, a need exists for an improved mechanism for preventing separation of the deployed louvers.

SUMMARY OF THE INVENTION

The present invention is directed to an improved reinforced burglar- and storm-resistant cover for windows and doors. The cover includes a pair of opposed and generally parallel tracks with an upper housing extending therebetween. A plurality of louvers are generally parallel to the upper housing with ends located and movable within the tracks. The louvers further include a first portion disposed generally parallel to the upper housing, and a second portion that is angled relative to the first portion.

A first cable is provided that includes a support member affixed to a bottom-most louver. The first cable is retractable so as to allow the louvers to be moved from a deployed position to a retracted position. A pair of second cables are included that have spacing members fixed thereto that engage the louvers in a manner to hold the louvers spaced at regular intervals. The cover further includes a pair of locking members, with each locking member associated with one of the tracks and movable between a first position and a second position. The locking members are adapted to automatically move from the first to the second position when the louvers are deployed from the retracted position to the deployed position.

In one aspect, the locking member extends generally parallel to the tracks and is rotatably coupled to the tracks by a plurality of coupling members. Each of the coupling members is pivotally coupled to both the track and the locking member. Each of the locking members further includes an extension member proximate the bottom of the cover which extends therefrom and engages the bottom-most louver as the bottom-most louver is deployed toward the bottom of the cover. As the bottom-most louver engages the extension members, the weight of the louver causes the locking members to pivot from the first position to the second position. Each locking member further includes a resilient member coupled to the locking member and the corresponding track to bias the locking member toward the first position.

In another aspect of the present invention, each of the second cables is provided with a plurality of spacing members. The spacing members are positioned at regular intervals along the second cables and engage the first portions of the louvers such that the second portion of one louver overlaps the next lower louver when the louvers are in the deployed position. The spacing means are adapted to prevent movement of the engaged louvers in either direction along the second cables, thereby preventing the separation of adjacent louvers.

The features and advantages of the invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 1:
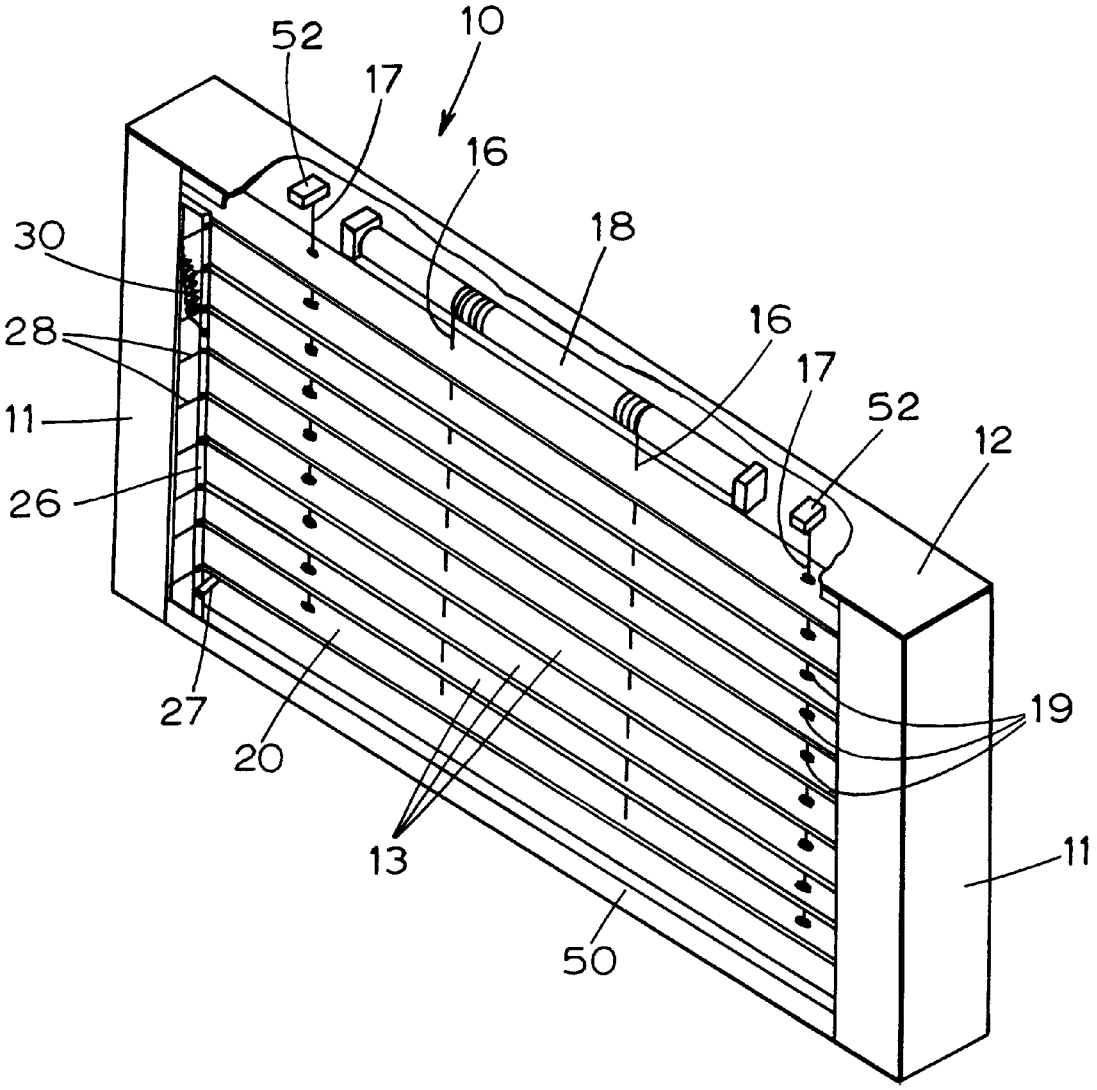
FIG. 1 is a rear isometric view of a reinforced burglar- and storm-resistant cover for windows and doors incorporating the present invention.

FIG. 1 illustrates a cover 10 for an opening which incorporates the automatic locking mechanisms according to the present invention. Referring to FIG. 1, the cover 10 includes a pair of transversely spaced tracks 11 which are secured at the top to an upper housing 12 and at the bottom to a bottom channel 50. The tracks 11, upper housing 12 and bottom channel 50 enclose a plurality of louvers 13 which are interconnected and suspended from the upper housing 12 by a pair of deployment cables 16 and a pair of support cables 17.

The upper housing 12 encloses and supports a take-up roll 18 to which the deployment cables 16 are attached. The support cables 17 are anchored to the upper housing 12 by a pair of brackets 52. The support cables 17 are provided with spacing members 19 that engage the louvers 13 to evenly space the louvers 13 when the cover 10 is in the deployed position, as will be further discussed below.

The cover 10 further includes an automatic locking mechanism which includes a locking member 26 attached to the track 11 by a plurality of connection members 28. Each of the connection members 28 is pivotally connected to both the track 11 and the locking member 26 to permit the locking member 26 to move between the deployed position as shown in FIG. 1 and a retracted position as further discussed below. The locking mechanism further includes a coil spring 30 attached to the track 11 and the locking member 26 which biases the locking member 26 toward the retracted position. An engagement member 27, such as a tripper bar, is attached to the locking member 26 proximate the bottom channel 50. The engagement member 27 extends from the locking member 26 and engages the bottom-most louver 20 as the louver 20 approaches the bottom channel 50, thereby causing the locking member 26 to move from the retracted position to the deployed position.

Figure 2:
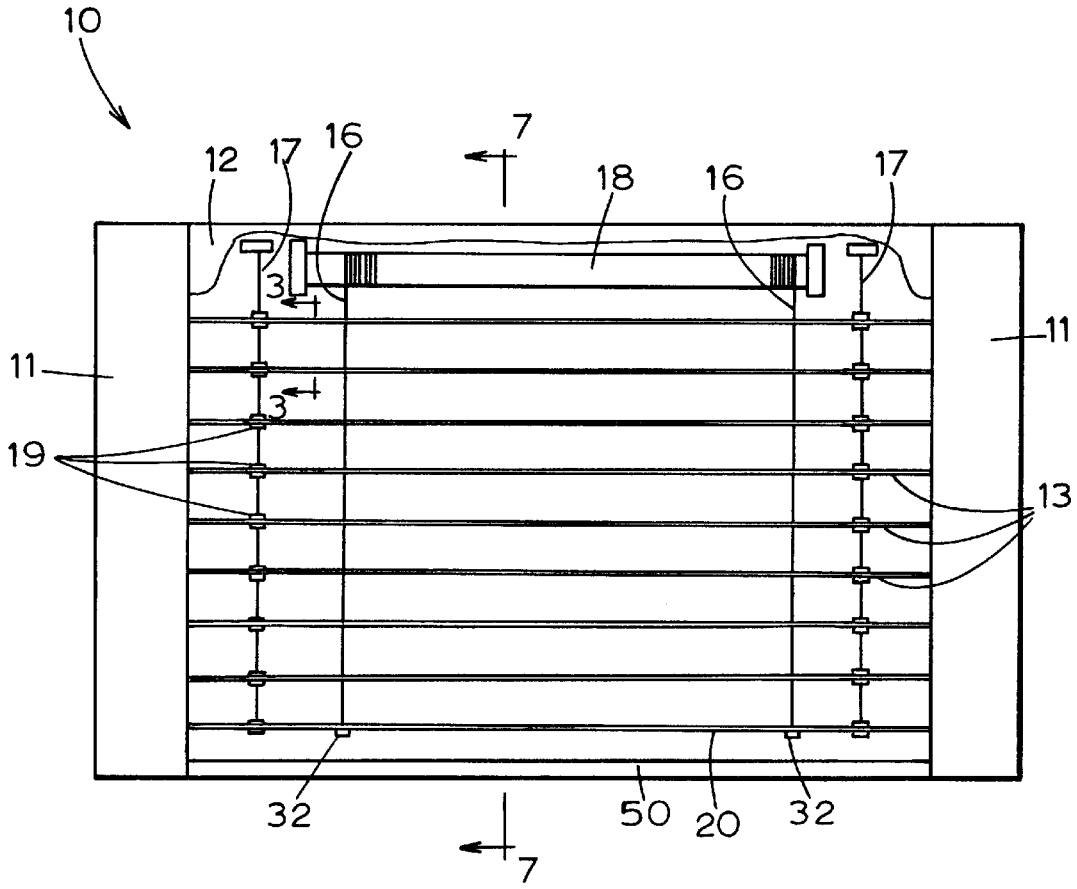
FIG. 2 is a rear view of the cover with the louvers deployed, showing the stop-like members according to the present invention.
Figure 3:
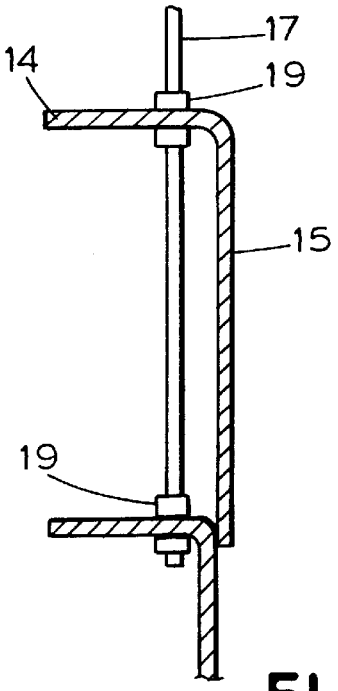
FIG. 3 is a side sectional view taken along line 3—3 showing stop-like members according to the present invention affixed to the second cable.

Referring to FIGS. 2 and 3, the interconnection of the louvers 13, the deployment cables 16 and the support cables 17 in the deployed position is illustrated. The deployment cables 16 extend from the take-up roll 18 through holes in each louver 13. Below the bottom-most louver 20, a support member 32, such as a pop-rivet, is attached to each deployment cable 16 and supports the weight of the bottom-most louver 20 when the cover 10 is in the deployed position. The support cables 17 extend from the brackets 52 through a second set of holes in each louver 13. The louvers 13 are spaced apart in the deployed position by spacing members 19 which prevent movement of the louvers 13 in either direction along the support cables 17.

The cross-sectional configuration and relative orientation of the louvers 13 is shown in FIG. 3. Each louver 13 has a horizontal flange 14 and a vertical flange 15. As discussed above, the spacing member 19 engages the horizontal flange of the louver 13 and prevents movement of the louver 13 along the support cable 17. Spacing members 19 for adjacent louvers 13 are spaced apart by a distance that is less than the width of the vertical flange 15 of the louvers 13. The spacing and support in both directions ensures that the opening cannot be accessed by separating adjacent louvers 13 when the cover 10 is in the deployed and locked position.

Referring to FIG. 2, when the cover 10 is in the deployed position as shown, each of the louvers 13 is held in place by the spacing members 19. The cover 10 is opened to the retracted position by causing the take-up roll 18 to roll up the deployment cables 16. The deployment cables 16 slide through holes of all the louvers 13 except the bottom-most louver 20. The support members 32 lift the bottom-most louver 20 which in turn lifts the other louvers 13 as it moves toward the take-up roll, thereby creating a stack of louvers 13 in the upper housing 11.

Figure 4:
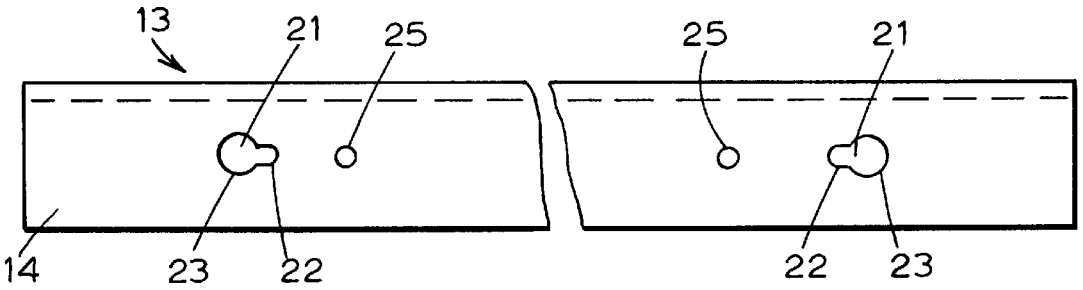
FIG. 4 is a top view of a louver showing holes and keyways in the louvers for receiving the support cables and stop-like members according to the present invention.
Figure 5:
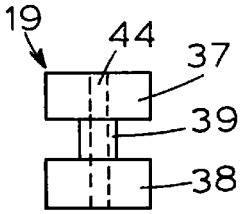
FIG. 5 is side view of a stop-like member according to the present invention.
Figure 6:
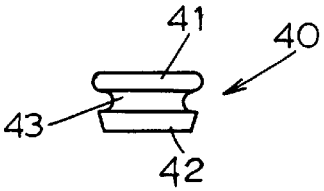
FIG. 6 is a side view of a plug for use with the present invention.

FIGS. 4–6 illustrate one arrangement for attaching the support cables 17 and spacing members 19 to the louvers 13. Each louver 13 has a pair of keyways 21 for receiving a spacing member 19. The keyway 21 has a narrow portion 22 and a wide portion 23 having a larger diameter than the narrow portion 22. The horizontal flange 14 further includes a second pair of holes 25 through which the deployment cables 16 are threaded.

Figure 6A:
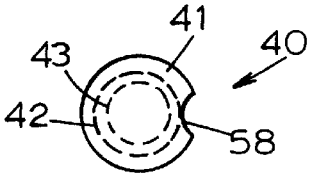
FIG. 6*a* is a top view of a plug for use with the present invention.

As shown in FIG. 5, each spacing member 19 has top and bottom portions 37, 38 having slightly smaller diameters than the wide portion 23 of the keyway 21, a stem 39 having a slightly smaller diameter than the narrow portion 22 of the keyway 21, and a longitudinal bore 44 through which one of the support cables 17 is inserted. Alternatively, the spacing member 19 could be made from a pair of opposing pop-rivets, one to prevent upward movement, and one to prevent downward movement along the cable 17. The arrangement further includes the plug 40 shown in FIG. 6. The plug 40 is fabricated from a flexible material and has a top portion 41, a lower tapered portion 42 having a maximum diameter slightly larger than the diameter of the wide portion 23 of the keyway 21 and a groove 43 having a diameter slightly smaller than the diameter of the wide portion 23. The plug 40 may also include a cut-out portion 58 in the top portion 41 as shown in FIG. 6*a* to permit insertion of the plug 40 in the keyway 21 without being obstructed by the top portion 37 of the spacing member 19.

The keyway 21 is provided to facilitate assembly of the louvers 13 and the support cables 17. A spacing member 19 is affixed to the support cable 17 threaded through the bore 44 by crimping the stem 39 to frictionally engage the cable 17. The spacing members 19 are positioned along the support cable 17 at intervals slightly less than the width of the vertical flanges 15. The support cables 17 and affixed support members 19 are passed through the keyways 21 of the horizontal flanges 14 until the louvers 13 are aligned proximate the appropriate support member 19. One of the portions 37, 38 of the support member 19 is passed through the wide portion 23 of the keyway 21, and the stem 39 is inserted into the narrow portion 22. To retain the support member 19 in the narrow portion 22 of the keyway, the tapered portion 42 of the plug 40 is inserted into the wide portion 23 of the keyway 21 until the plug 40 snaps into a retentive locking position.

Figure 7:
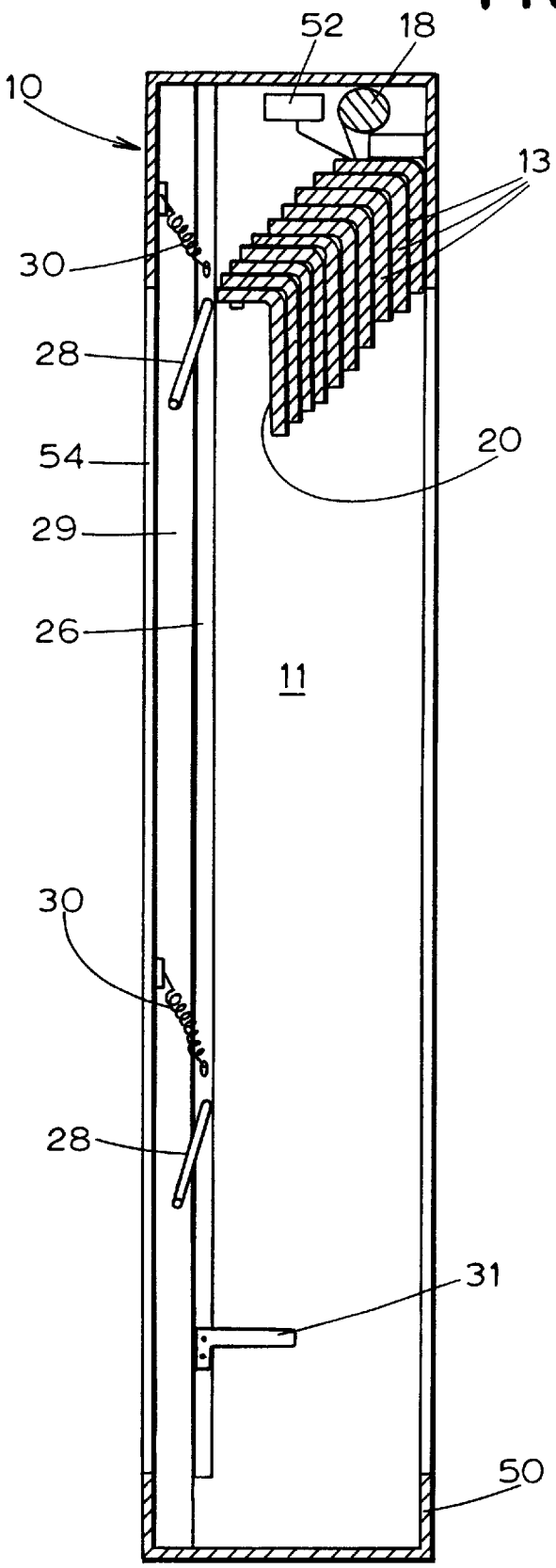
FIG. 7 is a side schematic view of the cover with the louvers and a locking member according to the present invention in a retracted position.

FIGS. 7–11 illustrate the attachment and operation of the locking mechanism according to the present invention. Referring to FIG. 7, the louvers 13 are illustrated in the retracted position in the track 11. A yoke 29 mounted to a rear wall 54 of the track 11 extends the entire length of the track 11. The locking member 26 is shorter than the track 11, and is connected to the yoke 29 by a plurality of connection members 28. The connection members are pivotally connected to both the yoke 29 and the locking member to facilitate the movement of the locking member between the retracted position shown in FIG. 7 to the deployed position shown in FIG. 9.

The locking member 26 further includes an extension member 31 extending therefrom proximate the bottom channel 50. One or more coil springs 30 are attached between the yoke 29 and locking member 26. The springs 30 exert a force on the locking member 26 which biases the locking member 26 toward the retracted position. The aggregate stiffness of the springs 30 is sufficient to force the locking member 26 to the retracted position when the extension member 31 is not engaged by the bottom-most louver 20. The springs are also flexible enough to allow the locking member 26 to move to the locked position when the weight of the bottom-most louver 20 is exerted on the extension member 31.

Although springs 30 are shown herein, other mechanisms for biasing the locking member 26 toward the retracted position. For example, implementing a counter balance system using a weight and pulley or a system using magnets to bias the locking member 26 toward the retracted position will be obvious to those of ordinary skill in the art and are contemplated by the inventors as having use in connection with the present invention.

Figure 8:
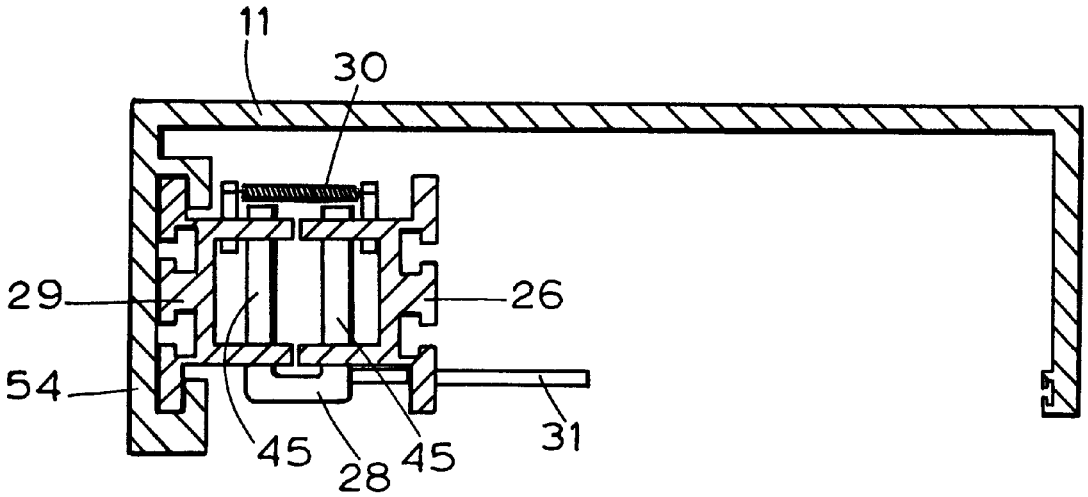
FIG. 8 is a top sectional view of a side track of the cover with the locking member in the retracted position.

FIG. 8 further illustrates the attachment of the locking member 26 to the track 11. The connection members 28 are in the form of C-shaped clamps having a circular cross-section. The connection members 28 have arms which extend through holes in the yoke 29 and locking member 26. Once inserted through the holes, the connection members 28 are secured by a fastener, such as a cotter pin or a threaded nut, to prevent the connection members 28 from slipping out of the holes during operation. Although C-shaped connection members 28 are shown herein, other shapes and mechanisms for movably or rotatably connecting the locking member 26 to the track 11 will be obvious to those of ordinary skill in the art and are contemplated as having use in connection with the present invention.

Figure 9:
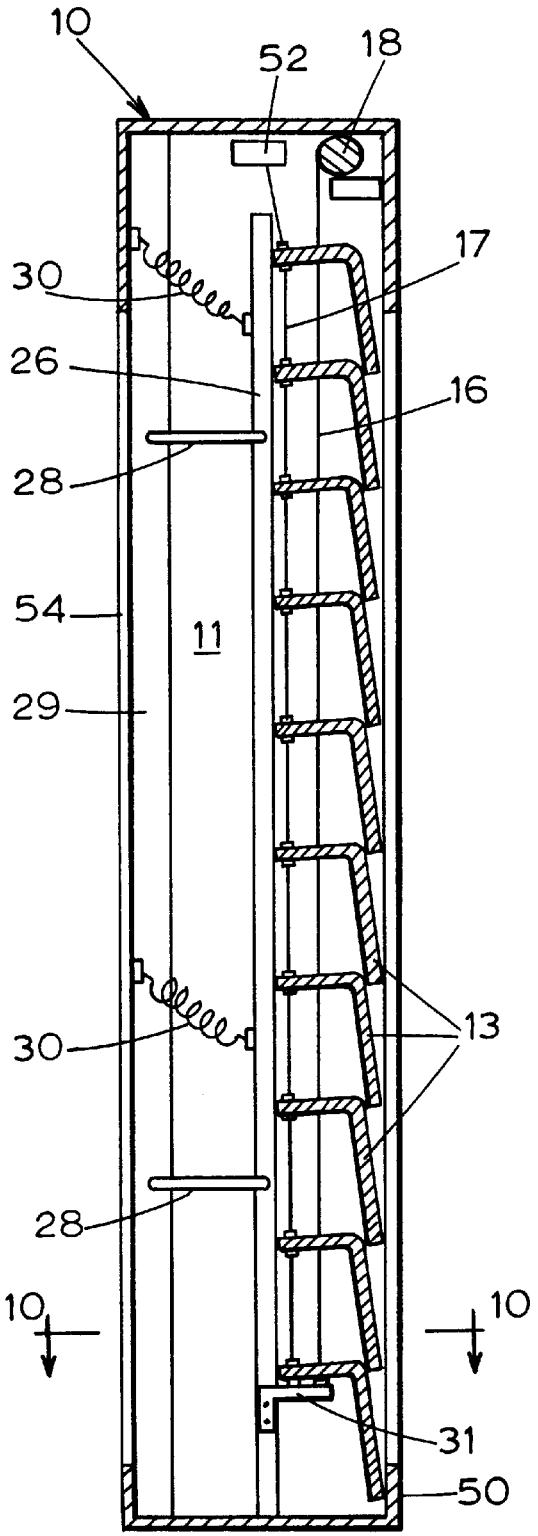
FIG. 9 is a side schematic view of the cover with the louvers and the locking member according to the present invention in a deployed position.

The movement of the louvers 13 and the locking members from the retracted position to the deployed position is illustrated in FIGS. 7 and 9. The retracted louvers 13 are deployed by causing the take-up roll 18 to unroll the deployment cable 16. When the portion of the support cable 17 between the bracket 52 and the top-most spacing member 19 becomes taut, the top-most louver 13 stops and the remaining louvers 13 continue moving toward the bottom of the cover 10. Each subsequent louver 13 is lowered until the corresponding portion of the support cable 17 tightens and the spacing member 19 prevents further downward movement. As previously discussed, the spacing members 19 are spaced to ensure that the vertical flange 15 of one louver 13 overlaps the adjacent louver 13 when in the deployed position.

When the bottom-most louver 20 engages the extension member 31, the weight of the bottom-most louver 20 causes the locking member 26 to pivot to the deployed position of FIG. 9. The force causes the connection members 28 to rotate about the points where the connection members 28 are connected to the yoke 29. As the connection members 28 rotate, the locking member 26 rotates from the retracted position until the bottom of the locking member 26 contacts the bottom channel 50.

Figure 11:
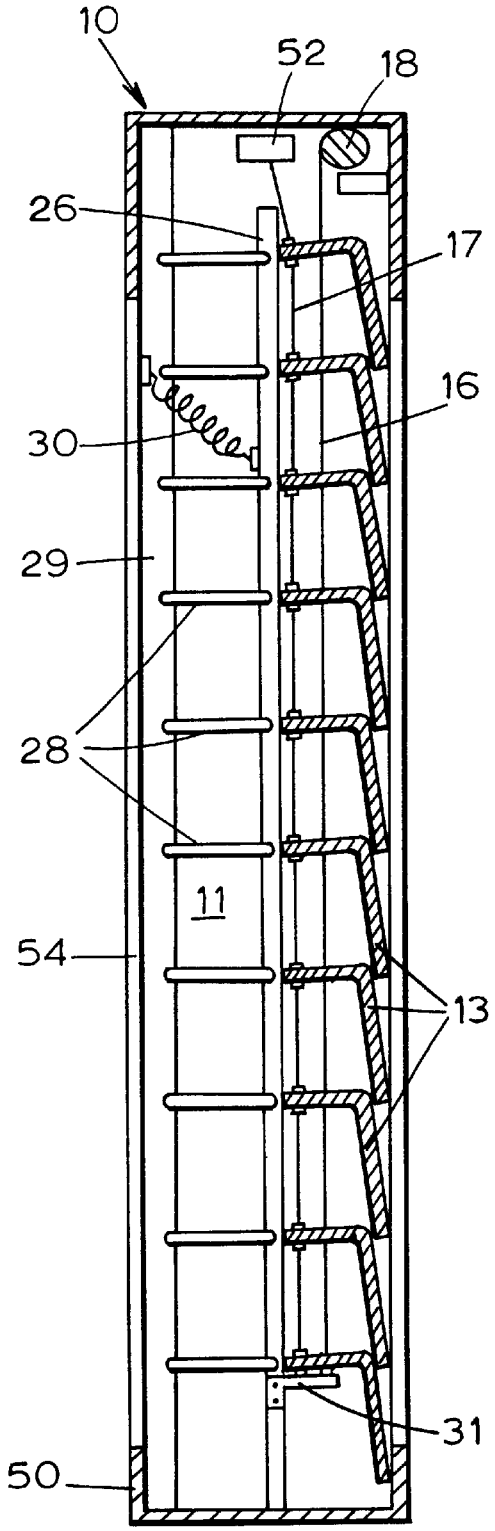
FIG. 11 is a side schematic view of the cover according to an alternative embodiment of the locking member according to the present invention with one connection member per louver.

When the locking member 26 contacts the bottom channel 50, the connection members 28 have rotated at least to a horizontal position or, preferably, slightly below horizontal to prevent the locking member 26 from moving back toward the retracted position if a force is exerted on the outside of the deployed cover 10. In this position, the locking member 26 is held stable by the bottom channel 50. The strength of the locking mechanism can be further increased by using additional connection members 28 to connect the locking member 26 to the yoke 29, as illustrated in FIG. 11.

Figure 10:
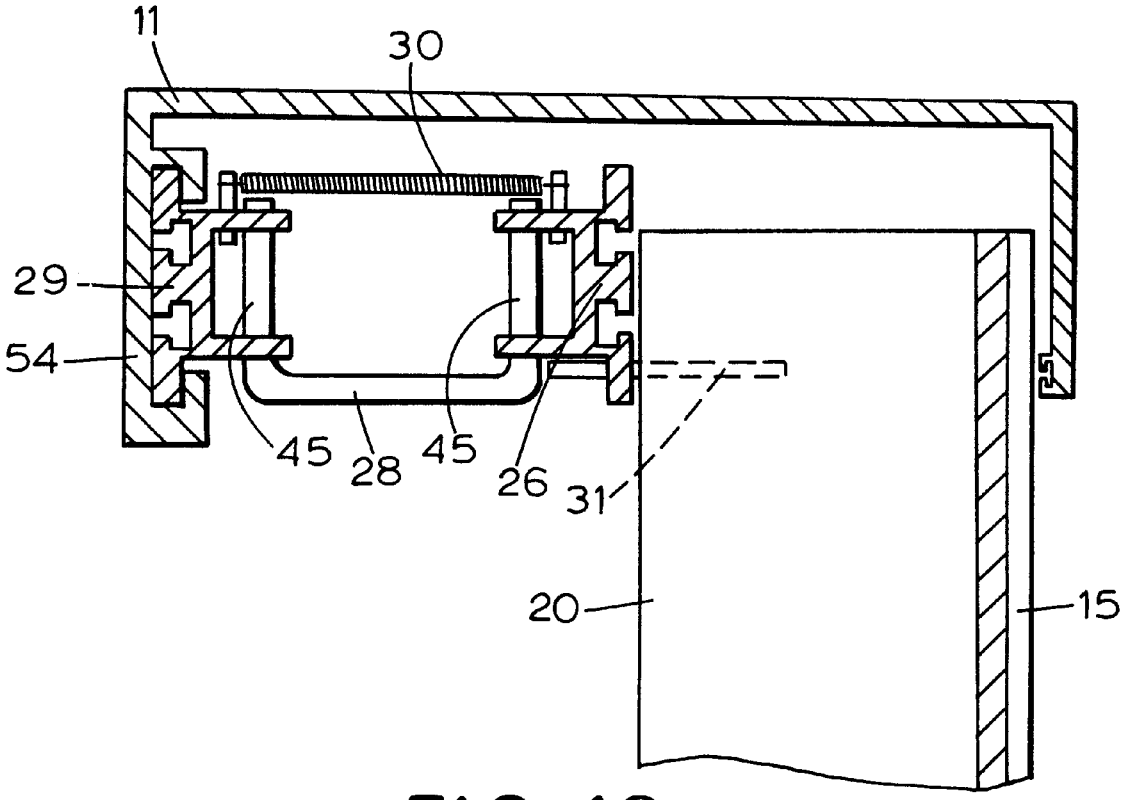
FIG. 10 is a sectional view taken through line 10—10 of the side track of the cover with the louvers and the locking member in the deployed position.

FIG. 10 further illustrates the locking member 26 in the deployed position. The bottom-most louver 20 has engaged the extension member 31, causing the connection member 28 to rotate toward the deployed position. The locking member 26 has moved closer to the front of the track 11 and cover 10, thereby narrowing the channel and forcing the louvers 13 against the front of the cover 10 to prevent substantial lateral movement of the louvers 13.

In the deployed position, the locking member 26 forces the louvers 13 against the front of the cover 10. The locking member 26 and connection members 28 prevent an external force exerted by an intruder or the elements from pushing the louvers 13 toward the opening. At the same time, the spacing members 19 prevent the louvers 13 from being forced apart, thereby exposing the opening. This configuration of the cover 10 provides the strength necessary to prevent intrusion through the opening by burglars and inclement weather conditions, and does so automatically as the louvers 13 are lowered to the deployed position. In this way, the cover with the locking mechanism and spacers according to the present invention can be installed and used effectively without manual intervention on any type of window and on windows on any floor of a house or building.

Other modifications and alternative embodiments of the invention will be apparent to those skilled in the art in view of the foregoing description. This description is to be construed as illustrative only, and is for the purpose of carrying out the invention. The details of the structure and method may be varied substantially without departing from the spirit of the invention, and the exclusive use of all modifications which come within the scope of the appended claims is reserved.

What is claimed is:

1. A security cover having a top and a bottom, comprising:

a pair of opposed generally parallel tracks facing each other;

an upper housing extending between and connected to said tracks proximate said top of said cover;

a plurality of louvers parallel to said upper housing and having ends located to move within said tracks wherein each of the louvers includes a first portion disposed generally parallel to said upper housing, and a second portion angled relative said first portion;

a first cable having a support member affixed to a bottom-most louver, said first cable being retractable so as to allow said louvers to be moved from a deployed position to a retracted position;

a pair of second cables having spacing members fixed to said second cables and engaging said louvers in a manner to hold said louvers spaced at regular intervals; and a pair of locking members, each locking member associated with one of said tracks and movable relative to said one track between a first position and a second position, each of said locking members comprising an extension member proximate the bottom of the cover, wherein each of said extension members is adapted to engage said bottom-most louver;

wherein said bottom-most louver engages said extension members to move said locking members from said first position to said second position when said louvers are deployed from said retracted position to said deployed position.

2. A cover according to claim 1, wherein each locking member is pivotally coupled to one of said tracks.

3. A cover according to claim 1, wherein each locking member is coupled to one of said tracks by a plurality of coupling members, and wherein each of said coupling members is pivotally connected to said locking member and to said track.

4. A cover according to claim 3, further comprising a pair of biasing mechanisms, each biasing mechanism associated with one of said locking members and adapted to bias said locking member toward said first position.

5. A cover according to claim 4, wherein each of said bias mechanisms comprises a resilient member having a first end coupled to one of said tracks and a second end coupled to said corresponding locking member, wherein said resilient member biases said locking member toward said first position.

6. A cover according to claim 1, wherein said second portion of said louvers has a width, and wherein said spacing members are spaced apart on said second cables by a distance less than the width of said second portion of said louvers such that said second portion of one of said louvers overlaps the next louver immediately below said one of said louvers when said louvers are in said deployed position.

7. A cover according to claim 1, wherein each of said spacing members prevents movement of said corresponding louver in both directions along said corresponding second cable.

8. A security cover having a top and a bottom, comprising:

a pair of opposed generally parallel tracks facing each other;

an upper housing extending between and connected to said tracks proximate said top of said cover;

a plurality of louvers parallel to said upper housing and having ends located to move within said tracks wherein each of the louvers includes a first portion disposed generally parallel to said upper housing, and a second portion angled relative said first portion;

a first cable having a support member affixed to a bottom-most louver, said first cable being retractable so as to allow said louvers to be moved from a deployed position to a retracted position;

a pair of second cables having spacing members fixed to said second cables and engaging said louvers in a manner to hold said louvers spaced at regular intervals;

a pair of locking members, each locking member associated with one of said tracks and movable relative to said one track between a first position and a second position; and a deployment mechanism comprising an extension member proximate the bottom of the cover, said extension member being adapted to engage said bottom-most louver, said deployment mechanism being adapted to deploy said locking members from said first position to said second position when said louvers are deployed from said retracted position to said deployed position and said bottom-most louver engages said extension member.

9. A cover according to claim 8, wherein each locking member is pivotally coupled to one of said tracks.

10. A cover according to claim 8, wherein each locking member is coupled to one of said tracks by a plurality of coupling members, and wherein each of said coupling members is pivotally connected to said locking member and to said track.

11. A cover according to claim 10, wherein said deployment mechanism further comprises a pair of biasing mechanisms, each biasing mechanism associated with one of said locking members and adapted to bias said locking member toward said first position.

12. A cover according to claim 11, wherein each of said biasing mechanisms comprises a resilient member, having a first end coupled to one of said tracks and a second end coupled to said corresponding locking member, wherein said resilient member biases said locking member toward said first position.

13. A cover according to claim 8, wherein said second portion of said louvers has a width, and wherein said spacing members are spaced apart on said second cables by a distance less than the width of said second portion of said louvers such that said second portion of one of said louvers overlaps the next louver immediately below said one of said louvers when said louvers are in said deployed position.

14. A cover according to claim 8, wherein each of said spacing members prevents movement of said corresponding louver in both directions along said corresponding second cable.

15. A security cover having a top and a bottom, comprising:

a pair of opposed generally parallel tracks facing each other;

an upper housing extending between and connected to said tracks proximate said top of said cover;

a plurality of louvers parallel to said upper housing and having ends located to move within said tracks wherein each of the louvers includes a first portion disposed generally parallel to said upper housing, and a second portion angled relative said first portion;

a first cable having a support member affixed to a bottom-most louver, said first cable being retractable so as to allow said louvers to be moved from a deployed position to a retracted position;

a pair of second cables having spacing members fixed to said second cables and engaging said louvers in a manner to hold said louvers spaced at regular intervals; and a pair of locking members, each locking member associated with one of said tracks and movable relative to said one track between a first position and a second position, each of said locking members further comprises an extension member proximate the bottom of the cover, wherein each of said extension members is adapted to engage said bottom-most louver, wherein said bottom-most louver engages said extension members to move said locking members from said first position to said second position when said bottom-most louver engages said locking members.

16. A cover according to claim 15, wherein each locking member is pivotally coupled to one of said tracks.

17. A cover according to claim 15, wherein each locking member is coupled to one of said tracks by a plurality of coupling members, and wherein each of said coupling members is pivotally connected to said locking member and to said track.

18. A cover according to claim 17, further comprising a pair of biasing mechanisms, each biasing mechanism associated with one of said locking members and adapted to bias said locking member toward said first position.

19. A cover according to claim 18, wherein each of said bias mechanisms comprises a resilient member having a first end coupled to one of said tracks and a second end coupled to said corresponding locking member, wherein said resilient member biases said locking member toward said first position.

20. A cover according to claim 15, wherein said second portion of said louvers has a width, and wherein said spacing members are spaced apart on said second cables by a distance less than the width of said second portion of said louvers such that said second portion of one of said louvers overlaps a portion of the next louver immediately below said one of said louvers when said louvers are in said deployed position.

21. A cover according to claim 15, wherein each of said spacing members prevents movement of said corresponding louver in both directions along said corresponding second cable.

* * * * *